US009540907B1

(12) United States Patent
du Plessis et al.

(10) Patent No.: US 9,540,907 B1
(45) Date of Patent: Jan. 10, 2017

(54) IN-LINE FIRE CONTROL SYSTEM FOR A HYDROCARBON FLUID STREAM

(71) Applicants: Jaco du Plessis, Granbury, TX (US); Raymond C. Sherry, Cleburne, TX (US)

(72) Inventors: Jaco du Plessis, Granbury, TX (US); Raymond C. Sherry, Cleburne, TX (US)

( * ) Notice: Subject to any disclaimer, the term of this patent is extended or adjusted under 35 U.S.C. 154(b) by 157 days.

(21) Appl. No.: 14/471,305

(22) Filed: Aug. 28, 2014

Related U.S. Application Data

(60) Provisional application No. 61/871,142, filed on Aug. 28, 2013.

(51) Int. Cl.

| | |
|---|---|
| ***A62C 35/64*** | (2006.01) |
| ***E21B 34/16*** | (2006.01) |
| ***E21B 35/00*** | (2006.01) |
| ***E21B 17/00*** | (2006.01) |
| ***E21B 34/00*** | (2006.01) |
| ***E21B 47/00*** | (2012.01) |

(52) U.S. Cl.
CPC ..... *E21B 35/00* (2013.01); *A62C 35/64* (2013.01); *E21B 17/00* (2013.01); *E21B 34/00* (2013.01); *E21B 34/16* (2013.01); *E21B 47/00* (2013.01)

(58) Field of Classification Search
CPC ..... A62C 35/68; A62C 35/64; A62C 35/645; E21B 34/16; E21B 43/12
See application file for complete search history.

(56) References Cited

U.S. PATENT DOCUMENTS

| | | | | |
|---|---|---|---|---|
| 2,000,381 | A | 5/1935 | Duffy | |
| 2,295,571 | A | 9/1942 | Ensminger et al. | |
| 3,620,299 | A | 11/1971 | Wiseman, Jr. | |
| 3,692,117 | A | 9/1972 | Wright | |
| 3,782,458 | A | 1/1974 | Slack | |
| 4,251,217 | A * | 2/1981 | Brasseux | G09B 25/02 434/219 |
| 4,283,159 | A * | 8/1981 | Johnson | E21B 43/0122 166/364 |
| 4,316,506 | A | 2/1982 | Poole | |
| 4,369,845 | A * | 1/1983 | Henson | C09K 8/42 137/318 |
| 4,899,827 | A | 2/1990 | Poole | |
| 5,105,893 | A | 4/1992 | Barnak | |
| 5,156,212 | A | 10/1992 | Bryant | |
| 5,335,730 | A * | 8/1994 | Cotham, III | E21B 43/12 166/374 |
| 5,425,885 | A | 6/1995 | Zhao | |
| 6,942,040 | B1 | 9/2005 | Phuong et al. | |
| 7,650,944 | B1 | 1/2010 | Boyle | |
| 2012/0227983 | A1 * | 9/2012 | Lymberopoulos | E21B 34/02 166/373 |

* cited by examiner

*Primary Examiner* — Zakiya W Bates
(74) *Attorney, Agent, or Firm* — Roger N. Chauza, PC

(57) ABSTRACT

A fire control system for use at a well site for sensing the presence of a fire and for automatically placing into operation apparatus for mixing the fluid produced by the well with a fire control agent to extinguish the fire. Much of the fire control system can be located underground to protect it from a fire.

17 Claims, 10 Drawing Sheets

IN-LINE FIRE CONTROL SYSTEM FOR A HYDROCARBON FLUID STREAM

RELATED APPLICATION

This non-provisional patent application claims the benefit of provisional application No. 61/871,142 filed Aug. 28, 2013.

FIELD OF THE INVENTION

The present document relates to a fire extinguishing system for oil and gas wells, where the wells are being drilled or producing hydrocarbon fluids.

BACKGROUND OF THE INVENTION

An oil well or a gas well produces a hydrocarbon product that burns when ignited. That is why hydrocarbon fuels are widely used in business, homes, vehicles and machines to power the same and produce heat and work. The hydrocarbon fuels can also inadvertently burn at the well site during drilling of the wells as well as production at the well site. It is not infrequent that a well will catch on, fire due to ignition of some of the hydrocarbon fuel that has escaped from the well equipment. The ignition of oil and gas at the well site can be caused by a spark generated by mechanical means or by static means, a flame, by lightning, or by persons intending to cause a fire or explosion. Often, well fires can be catastrophic and destroy not only the well itself but also surrounding wells and other structures. Hydrocarbon wells can be located close to communities and thus the safety of a well is of great concern to the community residents. A well fire can represent a loss that ranges in the millions of dollars in time, equipment, and structures, but also a substantial loss in the hydrocarbon resource itself.

At the present time there are different approaches in extinguishing hydrocarbon fires at gas or oil well sites. As can be appreciated, a gas well or an oil well can often be located at a remote area that is difficult to reach for firemen and fire fighting equipment. Various fire fighting vehicles or fixed fire fighting installations can be called upon to extinguish well fires, but often such techniques do not optimally handle well fires or well blowouts. While one group of machines can remove elements from the vicinity of the fire, another group can spray water to cool down the working area. Other examples well fire fighting techniques include employing explosives to cause a detonation in the immediate area of the fire in order to deplete it of oxygen and extinguish it, or plug the pipeline in an attempt to contain the fire. Other attempts include methods of capping the oil well while it is still under fire. Yet other attempts include spraying various chemicals or dry chemical powders on top or from the side of the fire at the well head, either from mobile platforms or fixed installations.

Another attempt for controlling blowouts at well sites has been the use of blowout preventers which are stacked above the well casing to, smash, pinch and scissor the drill pipe and close off the flow of the hydrocarbon fuel through the pipe. Also used is "Hydril" apparatus that is designed to close off the area around the drill pipe to prevent loss of the flow of the hydrocarbon product.

Further, an oil well fire requires many persons to be mobilized, making coordination of the individuals a difficult task that often results in slow and costly extinguishing and recovery operations that can further cause loss of life of those involved in working on or near the oil or gas well as well as the fire fighting equipment itself.

Hence, many of these well fire fighting techniques have been moderately successful, inefficient, costly, and often dangerous.

It can be seen that a need exists for a fire extinguishing system that overcomes the deficiencies and drawbacks of current oil/gas well fire extinguishing systems and methods. More particularly, what is needed is a system and method that can effectively prevent and/or immediately extinguish a potential oil well blowout or pressure fire before or after it reaches the surface. Yet another need exists for a fire control system that is located at the well site and can sense a situation where there is a fire, and immediately place the system into operation without the supervision of personnel. In addition, what is needed is a system that can be controlled either automatically or manually, can operate independently of or integrated with other fire extinguishing systems, and is cost effective and safe to install and, operate.

BRIEF SUMMARY OF INVENTION

According to a feature of the invention, disclosed is an in-line fire control system, and method of operation, which can immediately extinguish, retard or control either a potential or, existing fire in a drill casing, wellbore, or production piping or at the well head. More particularly, the well site fire control system and corresponding method includes, in one aspect, one or more storage tanks containing a fire control agent or other suitable extinguishing medium, where the storage tanks are located either above or below ground. Once a fire situation is detected, the stored fire control agents, liquids, foam, and/or chemicals are directly injected under pressure "in-line" into the well pipe, casing or wellbore below the ground, or injected directly in or around above-ground well head apparatus, or in the immediate vicinity of the well head.

According to another feature of the on-site well, fire control system is apparatus that pressurizes the fire control agent, whether, it be in powder, liquid, foam or gel form, to overcome any pressure generated down hole by the hydrocarbon well, in order to force the fire control agent into the hydrocarbon stream that is escaping from the well head. The fire control agents can also include, but are not limited to, any type of aqueous film forming foam (AFFF) in various forms manufactured on or off the site, or stored in atmospheric pressure tanks, pre-manufactured foam agents stored under pressure with or without an external pressure source, any type of inert gas, any type of dry chemical powder used for fire fighting in general, or any type of water mixed with an additive enhancing the fire fighting capability of the water. It should be understood that various combinations of the fire control agents can be employed at the same time, or in alternating sequences, to achieve the optimum ability to extinguish the particular type of fire experienced and under the existing environmental conditions. The pressurizing apparatus can be a positive displacement pump that pumps the fire extinguishing agent into the well casing, or a vessel containing a pressurized gas that forces the fire control agent out of its storage container and into the well casing, and other techniques for injecting the fire control agent into the hydrocarbon stream to extinguish and/or retard any downstream fire. On existing hydrocarbon wells, the fire control agent can be injected into the air adjacent the well by using nozzle arrangements strapped around the well head.

Another feature of the invention is the automated sensing and control of the fire control system to detect when the fire has been extinguished, and if the hydrocarbon fuel is oil, then the system periodically pulses the fire extinguishing agent into the fluid stream of the well to prevent any flareups of flame that can be caused by hot materials reigniting the oil escaping the well head. With gas wells, any gas that continues to escape from the well, head generally disperses in the air and does not remain in the area of production or drilling.

Yet another feature of the invention is that the fire control system can include an emergency shutoff valve located in the well casing so that once the fire is extinguished, personnel can close the valve and contain the hydrocarbon fuel and prevent it from escaping the well head. The system can also include surge protection apparatus to protect the well head equipment itself, as well as the underground fire control apparatus. To that end, high pressure surges from the well can be controlled and managed so that the well or system equipment is not damaged and remains operative to continue protection of the well site.

The fire control system of the invention is connected to the well pipe or casing or well head via one or more valves which, when closed, isolate the well casing from the fire control system. When it is desired to inject the fire extinguishing agent into the well casing, the valve(s) are opened by a control system so that the pressurized fire extinguishing agent is injected into the hydrocarbon stream to control any downstream fire or flame.

According to an embodiment, disclosed is a fire control system for use with a hydrocarbon extraction system of the type that extends underground and carries a hydrocarbon fluid stream to the surface. The fire control system includes one or more storage tanks located at a site of the hydrocarbon extraction, where each storage tank stores a fire control agent. The system further includes an injector for injecting the fire control agent into the hydrocarbon fluid stream so that the fire control agent is carried with the hydrocarbon fluid stream.

According to another embodiment, disclosed is a fire control system for use with a hydrocarbon extraction system of the type that extends underground and carries a hydrocarbon fluid stream to the surface, where the fire control system includes a storage tank located at a site of the hydrocarbon extraction. The storage tank is for storing a fire control agent. Also included is means for pressurizing the fire control agent. An injector is employed for injecting the pressurized fire control agent into the hydrocarbon fluid stream so that the fire control agent is, carried with the hydrocarbon fluid stream.

According to yet another embodiment, disclosed is a method of controlling conditions relating to a fire at a site of an oil or gas extraction operation carrying a hydrocarbon fluid stream. The method includes storing a fire control agent in a storage tank at the site, and pressurizing the fire control agent and injecting the fire control agent into the hydrocarbon fluid stream. The hydrocarbon fluid stream is carried together with the fire control agent to a location of a fire for facilitating the control of the fire.

The above summary is not intended to describe each and every disclosed embodiment or every implementation of the disclosure. The Description that follows more particularly exemplifies the various illustrative embodiments.

BRIEF DESCRIPTION OF THE DRAWINGS

The following description should be read with reference to the drawings, in which like elements in different drawings are numbered in like fashion. The drawings, which are not necessarily to scale, depict selected embodiments and are not intended to limit the scope of the disclosure. The disclosure may be more completely understood in consideration of the following detailed description of various embodiments in connection with the accompanying drawings, in which.

DETAILED DESCRIPTION

Figure 1:
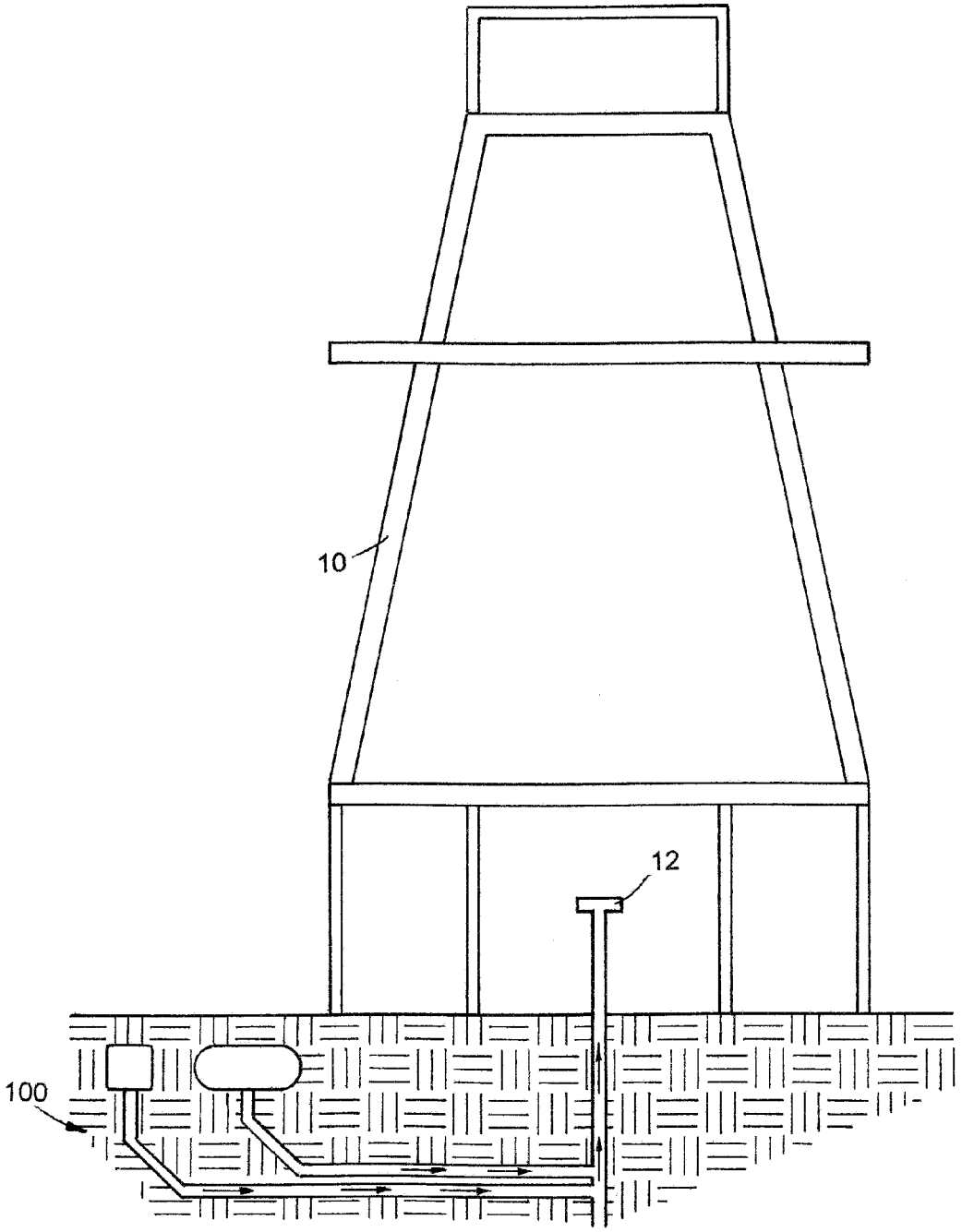
FIG. 1 illustrates one embodiment of a sub-surface in-line injection fire control system of an oil and gas drilling rig, where fire control agent storage tanks are located below ground.

FIG. 1 illustrates one embodiment of the oil and gas in-line fire control system, apparatus, and method, i.e., that is well adapted for use either with land-based wells or in marine applications, such as at sea with offshore rigs. However, the principles and concepts of the invention can be utilized in other applications other than those described herein. For example, the fire control system can be used in industrial applications where volatile gases and liquids are carried in pipelines. The fire control system 100 includes one or more storage tanks for holding one or more fire control agents, one or more supply pipes, one or more sensors (not shown), and one or more valves (not shown), among others. Well known fire control agents include mediums that can either extinguish a fire or retard a fire, or both. The simplified operation of the fire control system 100 is that when a fire is detected at the well head 12, or in the vicinity thereof, the system 100 begins to inject the fire control agent, under pressure, into the well casing so that the agent is mixed with the hydrocarbon fluid that is forced up the casing by the subterranean ground pressure. The fire control agent is injected with a sufficient volume into the hydrocarbon fluid so that any downstream fire is extinguished. As used herein, the term "fluid" includes either a gas or a liquid, and a hydrocarbon fluid includes either a gas, such as natural gas, or an oil, such as petroleum oil. The storage tanks are preferably located underground so that they are not damaged by any fire at the well head, or heated by a fire to reduce the effectiveness of the fire control agent stored therein. As will be described below, the fire control system can be employed with well sites where the drilling operation is being conducted, as compared to production wells where the drilling has been completed and the well is equipped for producing the hydrocarbon product and transferring it to a pipeline or a storage tank.

As noted above, the fire control agent stored in the storage tanks 102 and 104 (FIG. 2) can be mediums that are capable of either extinguish flames, or retarding flames. Indeed, one tank 102 can hold a fire control agent that is adapted for extinguishing flames, and the other tank 104 can hold a fire control agent that is adapted for retarding flames. Various tanks can be provided to hold fire control agents that are adapted for controlling, retarding or preventing fires at the well site. For example, if a lightning strike is detected at the well site, but no fire is immediately detected, then the system 100 can make connections between a storage tank holding a fire preventive medium and the pipeline 116 so that if any hydrocarbon fluid is escaping at the well head, no fire will be started by the ignition of the lightning strike to the well head apparatus. As will be described below, a fire or flame in the vicinity of the well head can be detected by infrared (IR) or ultra-violet (UV) mean. A lightning strike can also be detected by the increase in the voltaic potential of the metallic well head equipment.

Figure 2:
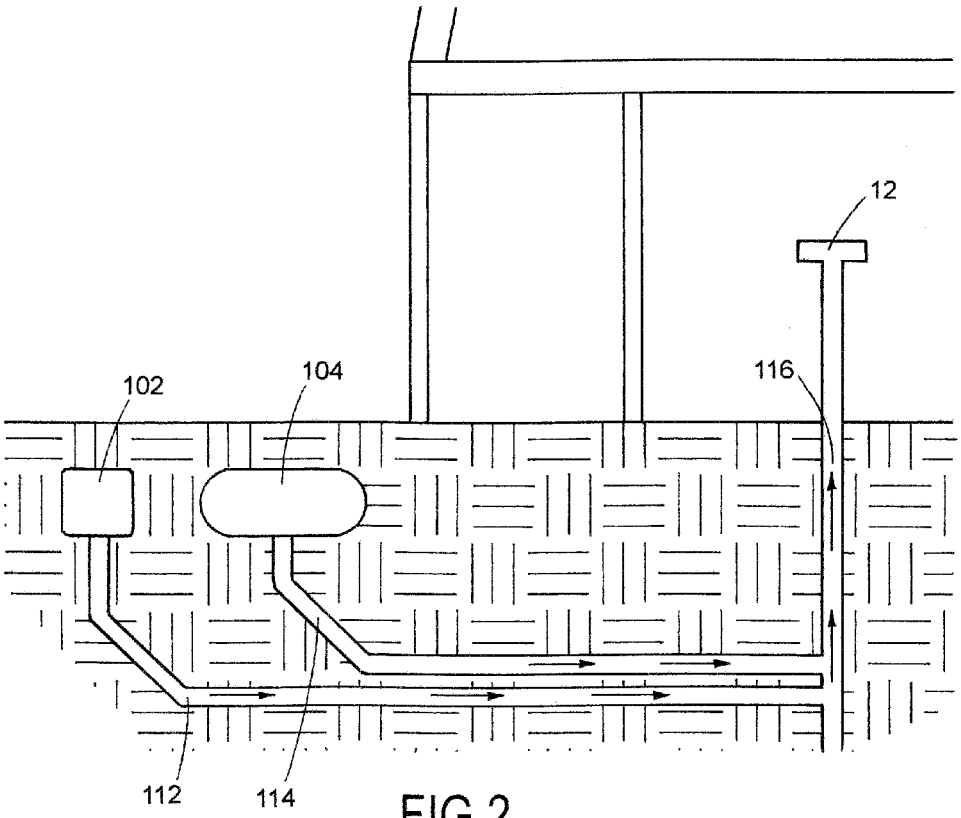
FIG. 2 illustrates an enlarged view of the embodiment of FIG. 1, further illustrating a sub-surface in-line injection fire control system of an oil and gas drilling rig, where fire control agent storage tanks are located below ground.

FIG. 2 illustrates in more detail the fire control embodiment of FIG. 1, including fire control agent storage tanks 102 and 104, where the tanks 102 and 104 are connected to and communicate with respective supply pipes 112 and 114. Supply pipes 112 and 114 further connect and join with a main drilling pipeline, wellbore, or casing 116. The pipeline 116 extends between the surface well head 12 and the subterranean supply of the hydrocarbon fluid. The pipeline 116 can be more than a mile in length. In any event, the pipeline 116 can be connected to supply pipes 112 and 114 via any type of valve, such as a one-way check valve. The check valve would allow the fire extinguishing agent to be communicated from the supply tanks 102 and 104 to the pipeline 116, but when the fire control system 100 is inactive, the check valves would prevent the pressurized hydrocarbon fluid from being coupled back to the fire control system 100. In this embodiment, the storage tanks 102 and 104 are situated or located below ground (subsurface), but in other embodiments one or more storage tanks can be located above ground. Either of the storage tanks 102 or 104 can hold one or more of fire control agents, including but not limited to water or any type of pre-manufactured fire fighting foam containing either extinguishing, retarding or preventative properties. The fire control agent can be stored under pressure, with or without an external or internal pressure source, where the concentrate is emulsified within the water, or kept separate and mixed with a water source on or off the scene of the fire. Pre-manufactured foam can also be used in various compositions and mixtures, whether a self-expanding foam or water mixed with various chemicals or inhibitors, inert gas, carbon dioxide, nitrogen, dry chemical powder, monoamrnonia phosphate, Monnex®, Purple K, PKP, and any suitable liquid or gas composition that may become available in the future.

It is contemplated that the fire control agent (i.e. water, foam, pre-manufactured foam, inert gas, dry chemical powder) can be injected into the main drilling or pipeline 116 using any type of configuration of nozzle or spray heads. For example, when using a foam composition, one or more foam generating/expanding/spreading nozzles can be utilized and located along the main drilling or production pipeline 116. Other types of nozzles or spray heads can be used to spread/disperse the one or more fire control agents, and include but are not limited to the following: atomizer nozzles, air-atomizing nozzles, fine spray nozzles, hollow cone nozzles, flat fan nozzles, full zone nozzles, smooth bore nozzles, fixed gpm nozzles, variable stream flow nozzles, constant flow stream nozzles, automatic variable flow nozzles, and broke or aspirated stream nozzles. Further, the nozzle or spray heads can be configured to accommodate any liquid drop size.

The storage tanks 102 and 104 can be either an atmospheric pressure polyethylene tank, pressure vessel tank, or any sealed or open liquid, solid, or gas storage tank. In addition, the fire control system 100 is not limited to two fire control agent tanks, but can include as many tanks as desired at one location, where the tanks can have various dimension, sizes, materials, and volumetric space. The number and size of the storage tanks 102 and 104 and type of fire control agent(s) will depend on various factors, such, as the size of the drilling operation, location of the drilling operation or pipeline, the type and pressure of hydrocarbon fluid being drilled for or produced, type (vertical or horizontal) or configuration of the drilling likelihood of a blowout/fire, conditions of the surround environment, and war zone, terrorist, or vandalism activity, etc.

The fire control system 100 can be operated both manually on-site, remotely off-site, and/or automatically with or without an operator. For example, if the fire control system 100 is installed on site as a manually operated system, then in the presence of a fire, one or more operators can safely open one or more valves on the fire extinguishing storage tanks, whether they be located above or below ground. The fire control agent is then dispensed into the underground piping that leads to the main pipeline or wellbore, thereby quickly and effectively extinguishing or minimizing the fire. In a remote or wireless operation, an operator, software, or algorithm and corresponding controller located on or off-site can monitor conditions within the drilling or production pipeline or wellbore and in the presence or detection of an upcoming fire or blowout, the operator, software, or algorithm can immediately send a control signal via a wired or wireless network to the one or more of the storage tanks 102 and 104, whether they be located above or below ground, or to one or more valves in communication with the storage tanks, thereby dispensing/injecting the fire control agent directly into the drilling or production pipeline 116. In the automatic operation, there may be one or more sensors or detectors in near, or around the drilling or production pipeline to sense an existing or impending fire or blowout. In such a scenario, an algorithm, software, or computer system will send a control signal to one or more of the tanks or valves to automatically release the fire control agent from the storage tanks 102 and 104 into the connecting supply pipes 112 and 114 and thus into the main pipeline 116, thereby quickly extinguishing or inhibiting the fire. This is all carried, out without the need for, an on-site or off-site operator. In addition, the one or more supply pipes 112 and 114 that connect the storage tanks 102 and 104 to the main drilling or production pipeline 116 can either be located above a blowout preventer (BOP) or below the BOP, or in the pipeline 116 several feet or miles below the ground surface.

Further, it is contemplated that the fire control system 100 can be the sole fire control system relied upon, or complementary and supplementary to existing fire extinguishing systems. For example, in one version, the fire control system 100 can act as a supplement and/or integrated with an existing mobile or fixed installation oil well fire extinguishing system, such as where the fire control agent is sprayed or dispersed above the surface at the well head. In other words, the fire control system 100 can be the underground system or method of extinguishing fires within the drilling or production pipeline, and other systems and methods can be used to attack the fire from the surface (above ground) at the same time or by sequential operation. In another version, the fire control system 100 can be operated automatically to inhibit or slow down a fire during the time that fire extinguishing crews and personnel are mobilized to the fire site, thereby reducing the risk of damage to the pipeline, rig or drilling site, and equipment, and further reducing the risk of injury or loss of life to fire extinguishing crews and personnel.

Referring again to FIG. 2, supply pipes 112 and 114 feed the fire control agent from the storage tanks 102 and 104 to the main pipeline 116 in response to a fire or blowout, or when sensing the conditions leading to a fire or blowout. In the event a fire or blowout condition arises, one or more valves (not shown) will open at the junction of supply pipes 112 and 114 with the tanks 102 and 104. One or more valves (not shown) may further be activated anywhere along supply pipes 112 or 114 or at the junction with the pipeline 116. It is contemplated that in addition to or in lieu of supply pipes 112 and 114, any number of supply pipes or any configuration of pipes can be used to feed the fire control agent from one or more storage tanks 102 and 104 into the main drilling pipeline 116. In addition, there may be any number of connection points, opening, or valves along the pipeline 116 that allow fire control agents to be injected along the length of the pipeline 116. For example, in one embodiment, there may be varying amounts of a fire control agent injected into the pipeline 116 along its length, such as in a gradient pattern, wherein the majority of the fire control agent is injected within the pipeline in close proximity to the source of the fire, and less fire control agent is injected in other areas of the pipeline 16, or vice versa, or all injected with the same volume, pattern, and speed.

Figure 3:
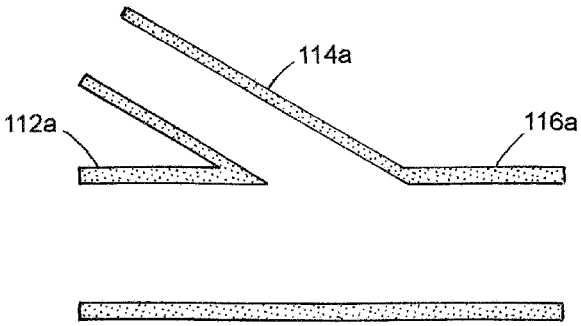
FIG. 3 illustrates one embodiment of a y-pipe joint configuration for joining fire control agent feed lines into a main piping line.

FIG. 3 illustrates an alternative embodiment of FIG. 2, namely a y-joint where the supply pipe 114*a* joins the main pipeline 116*a*. The other supply pipe 112 can be joined to the main pipeline 116 in a similar manner. Here, supply pipe 114*a*, which is connected to a respective fire control agent storage tank 104, can merge and join into a secondary pipeline 116*a*, where the secondary pipeline 116*a* further connects to the main drilling or production pipeline 116, casing, or wellbore. It is contemplated that the fire control system 100 can include any type of piping configurations and joints, including but not limited to T-joints, as well as 2-axis, 3-axis, 4-axis, and 5-axis joints. Further, it is contemplated that the fire control system 100 may include any number or type of valves communicating with one or more fire extinguishing storage tanks and corresponding pipelines, including but not limited to one-way cheek valves, two-way valves, manually operated valves, solenoid valves, automatically operated valves, globe valves, piston valves, gate valves, butterfly valves, ball valves, rotary valves, gate valves, stop valves, rotary valves, lift check valves, tilting disc valves, swing check valves, diaphragm valves, safety valves, pneumatic valves, relief valves, and control valves.

Figure 4:
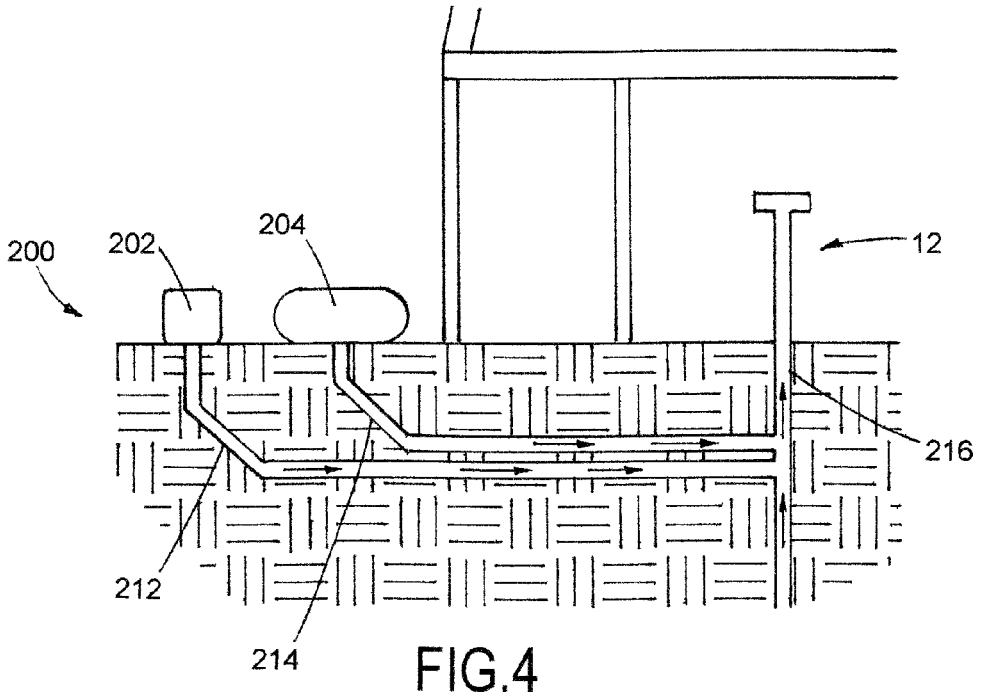
FIG. 4 illustrates one embodiment of a sub-surface in-line injection fire control system of an oil and gas drilling rig, where fire control agent storage tanks are located above ground.

FIG. 4 illustrates another embodiment of a fire control system 200, where plural fire control agent storage tanks 202 and 204 are situated or located above the ground surface. For example, storage tanks 202 and 204 may be located on a skid, mobile platform, mobile vehicle, or fixed to the ground, surface or platform and have connection points, such as valves, that allow them to connect to underground supply pipes 212 and 214, respectively. Similar to FIG. 2, supply pipes 212 and 214 connect to the main drilling pipeline 216. As previously mentioned, it is contemplated that there may be any number of storage tanks, supply pipes, valves, and sensors in any configuration, shapes, sizes, or dimensions.

Figure 5:
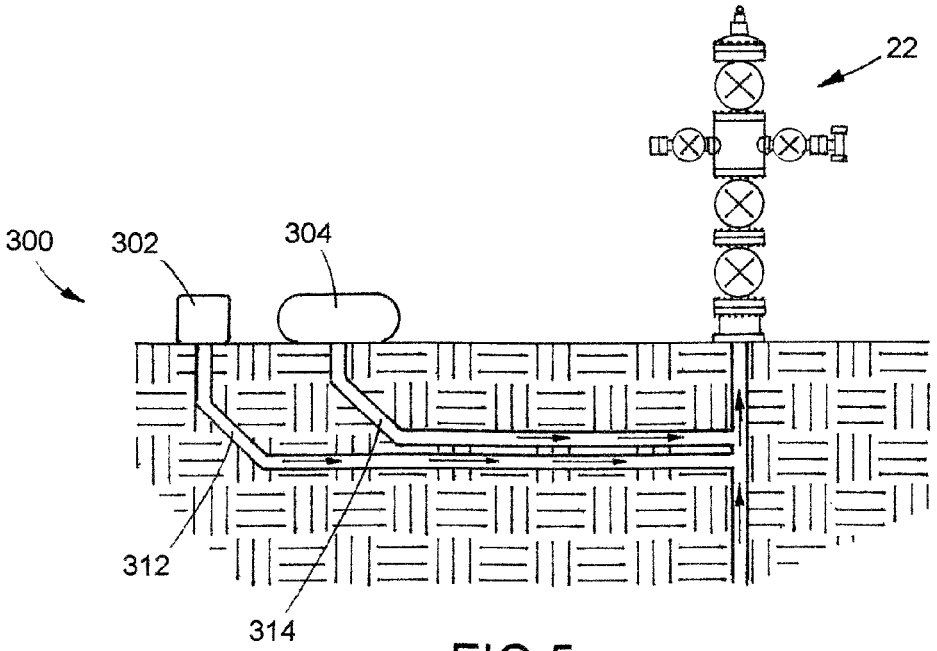
FIG. 5 illustrates one embodiment of a sub-surface in-line injection fire control system of an oil and gas process or production head, where fire control agent storage tanks are or located above ground.

FIG. 5 illustrates another embodiment of a fire control system 300 constructed according to the invention, where the fire control agent storage tanks 202 and 204 are situated or located on or above the ground surface. The embodiment of FIG. 5 can be utilized with a gas or oil production wellhead 22 that includes a plurality of conventional ports, valves, and outlets.

Figure 6:
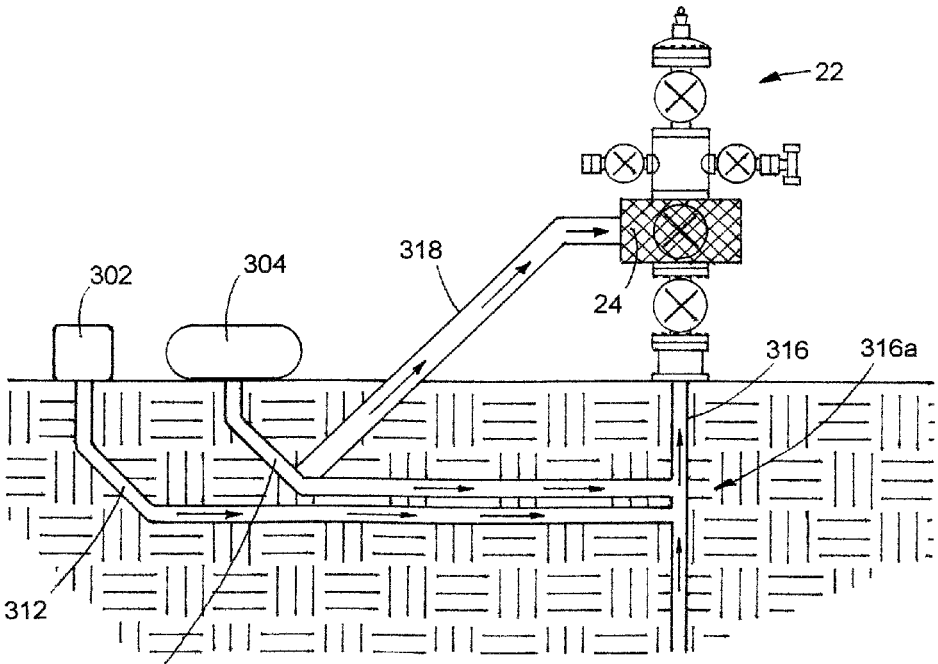
FIG. 6 illustrates one embodiment of an in-line injection fire control system having an alternative, fire control agent line connected directly in-line or to the well or production head.

FIG. 6 illustrates yet another embodiment of a fire control system that is adapted for coupling a fire control agent directly to a production well head 22 by way of an additional supply pipe 318 that is branched from the supply pipe 314. The fire control agent can also be coupled from main pipeline 316 and fed directly into an inlet 24 of well head 22. In this embodiment, the fire control agent is injected directly to the well head 22 both above the surface at inlet 24, as well as indirectly below the surface at location 316*a*. Here, the connection point of piping 318 and inlet 24 can either be above or below a blow-out preventer (BOP). In other embodiments, supply pipe 318 can be directly connected to either one or more supply tanks 302 or 304.

Figure 7:
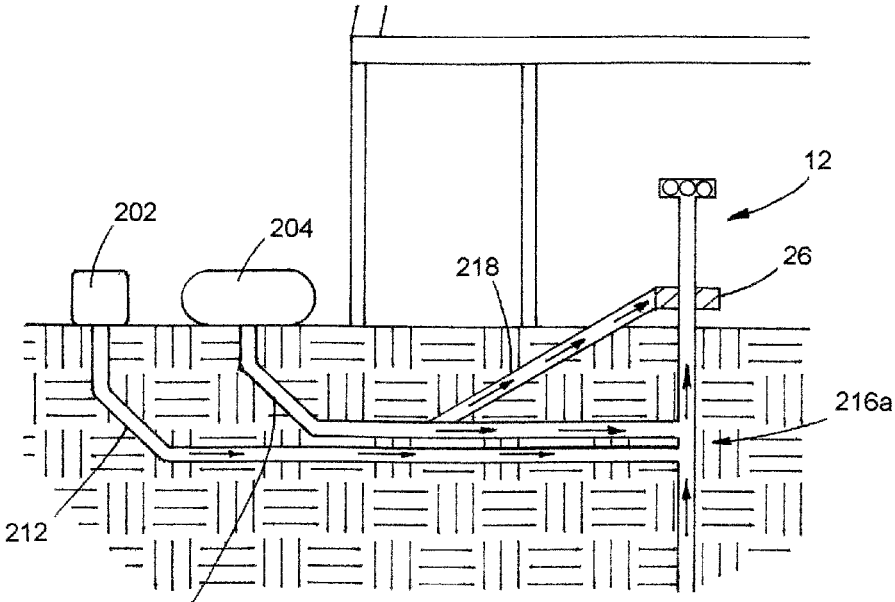
FIG. 7 illustrates one embodiment of an in-line injection fire control system having an alternative fire control agent line connected directly in-line or to the well or production head.

Much like the fire control system of FIG. 6, the fire control system illustrated in FIG. 7 is used with the drilling well head 12, where the supply pipe 218 couples a fire control agent from supply pipe 214 and feeds the same directly to an inlet 26 of a well head 12. Again, the fire control agent is injected both above the surface to the well head 12 at inlet 26, and indirectly to the well head 12 at a location below the surface at location 216*a*. Here, the connection point of supply pipe 218 to the well head inlet 26 can either be above or below a blow-out preventer (BOP). One or more valves can be opened manually or automatically at inlet 26 to directly inject the fire control agent therein. In other arrangements, the supply pipe 218 can be connected directly to either one or more of the storage tanks 202 or 204.

Figure 8:
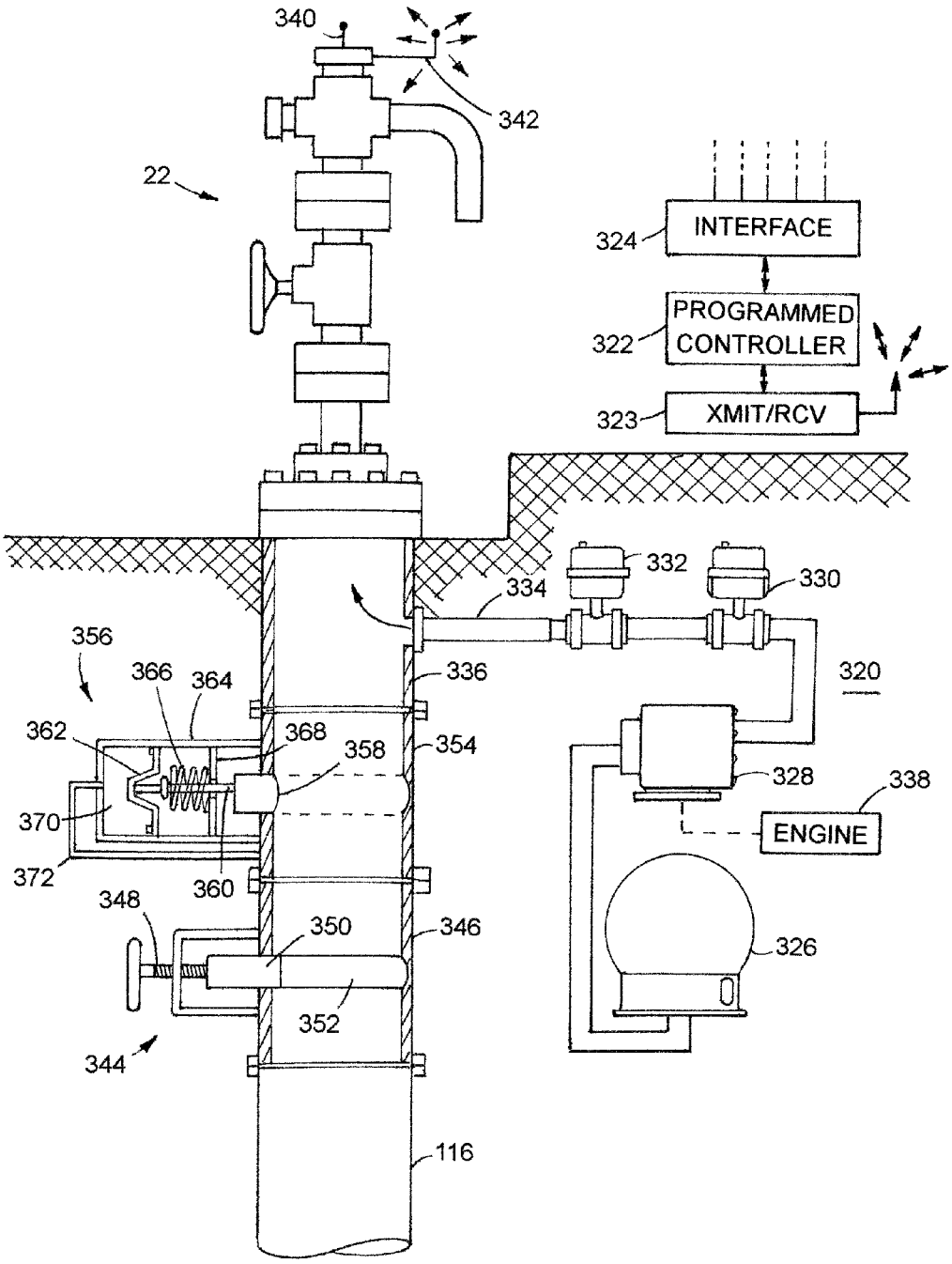
FIG. 8 illustrates an embodiment of a fire control system that utilizes an engine to drive a pump to force the fire control agent into the fluid pipe of the well head, and which utilizes a surge protection mechanism and an emergency shutoff valve.

With reference to FIG. 8, illustrated is a fire control system 320 that utilizes underground equipment for preventing and combating fires in and around a well head 22. The fire control system 320 is operated by a programmed controller 322 which monitors the various sensors located at and around the well site, and reacts accordingly. The programmed controller 322 can be connected by wireless means via a transmitter/receiver 323 to a remote location so as to be updated with software and to report the status of the well head 22. The controller 322 is programmed to carry out a self-test routine to determine if the subsystems are operating correctly, and to report to the remote location any problems or irregularities found. The self-test can be initiated manually on site, by remote action or via a fully automated process. The self-test can involve the injection of a small amount of a fluid that is inert to hydrocarbon fluids, a radioactive material, a magnetic component, a salinity changing material, or other suitable material, into the fluid stream at the well head 22 or pipeline 116. The test material is monitored at a downstream location to verify the presence of the test material and the characteristics thereof to determine if a change has occurred. Other techniques can be utilized to inject a substance in the fluid stream and verify that such substance is present at a downstream location. Various cleaning liquids can be injected at the nozzles to clean the same. Particulate matter, such as abrasives, can be injected upstream of the injection nozzles to clean the same and recapture the particulate matter at a downstream location, as well as any residue removed from the equipment.

The programmed controller 322 can be programmed to receive commands from the remote location to interrogate the various sensors to diagnose problems in the system should they exist. To that end, the programmed controller 322 is coupled to an interface 324 which is, in turn, connected to the various sensors and to the fire control equipment to operate the same in a systematic manner. While not shown, the electronics and electrical equipment of the fire control system can be powered with AC electrical power if the same is available at the well site, or alternatively by a battery that is charged by solar or wind energy. The sensors and the electrical equipment at the well site can be connected to the interface either by metal conductors, or by wireless means. An important feature is that cameras, microphones and other visual and audio sensing equipment can be employed to provide real time monitoring of the site to the remote location. The video and audio pickup at the site can be recorded and time stamped so that a record is maintained and so that the stimulus can be played back to analyze and diagnosis problems at the well site. The on-site microphones can pick up audio sounds such as explosions and raging fire sounds that are helpful to determine when a fire has started, and collect evidence of arson and the like, as well as video of the identity of unauthorized individuals. The microphones can pick up the coded sounds of emergency vehicles, les, and when verified and authenticated, gates to the site can be automatically unlocked by the controller 322.

Another sensor that can be utilized is an oxygen sensor for sensing the amount of oxygen surrounding the engine 338 that drives the pump 328, both of which are described below. The internal combustion engine 338 requires oxygen to operate. An auxiliary oxygen supply can be available adjacent to the engine to assure that if the environment is deficient of oxygen due to a fire on the surface, then the lack of oxygen can be sensed by the controller 322 and the auxiliary supply of oxygen can be connected to the engine. If the ambient oxygen adjacent to the engine 338 later becomes sufficient to support combustion in the engine 338, then the auxiliary supply of oxygen can be throttled back or shut of completely.

In the fire control system 320 of FIG. 8, buried underground is a storage tank 326 filled or partially filled with a fire control agent that either extinguishes or retards (or both) fires that could occur as a result of a hydrocarbon fluid escaping from the well head 22 or associated equipment. As can be appreciated, the selection of a fire control agent to be placed in the storage tank 326 will be a function of the type of hydrocarbon product produced from the underground well to the well head 22. While not shown, the underground storage tank 326 would have a surface access to refill the tank should the fire control agent be used or spent to control a fire. Also, if the storage tank 326 is pressurized, a pressure sensor would be attached to the tank and adapted for reporting the pressure to the programmed controller 322. Other sensors can be connected to the storage tank 326, including a temperature sensor, a sensor that senses the volume of the fire control agent that remains in the storage tank 326, chemical sensors to determine the activity of the fire control agent, leak detectors, etc. The well head 22 is equipped with a sensor 340 that senses a lightning strike to the well head 22. Also shown is an infrared or ultraviolet sensor 342 connected to the well head 22 to monitor in an omnidirectional manner the existence of a flame. There can be multiple infrared sensors located around the well head 22 so that if one is damaged by a fire, the other infrared sensors can be used to assure whether or not a fire exists. Indeed, the multiple sensors can be polled periodically and if a majority of the sensors 342 show that a fire exists, or does not exist, then the programmed controller 322 can react accordingly. Other types of flame detectors can be utilized, and a mix of different types of fire detectors can be utilized at the well site to determine whether or not a fire exists. The fire control system can monitor other parameters and take the same into consideration in adjusting or operating the system for optimum efficiency. For example, the atmospheric pressure can be monitored, the pressure within feed tanks, the suction pressure of various venturi components, the temperature adjacent the well head and of various components in the fire zone, etc. The programmed controller 322 would monitor all such sensors.

The fire control agent is coupled from the storage tank 326 to a positive displacement pump 328 via a pipe. The pump 328 receives the fire control agent from the storage tank 326, preferably by gravity feed, and pressurizes the same to a pressure that exceeds the fluid pressure in the pipeline stub 336. Again, pipe stub 336 can be equipped with a pressure sensor so that the pressure therein is known and reported to the controller 322, whereby the controller 322 can operate the pump 328 so that the pressure of the fire control agent is greater than the pressure that exists in the pipe stub 336. In practice, the positive displacement pump 328 can produce pressures in excess of, for example, 20,000 psi to overcome the pressures that can be expected to exist in the pipe line 116. The positive displacement pump 326 can be driven by an engine 338, where the torque generated by the engine 338 is controlled by the controller 322. In the event that the well head 22 operates with a gas well, then the gas at the well head 22 can be employed by the engine 338 as a fuel. Otherwise, a tank of natural or propane gas, or gasoline or diesel can be uses as a fuel for the engine 338. As an alternative to the use of an engine 338, an electrical motor can be employed, provided that AC electricity is available at the well site. In the absence of electrical energy or fuel at the well site, a bank of batteries can be maintained in a charged condition by solar or wind means. The storage capability of the bank of batteries would be sufficient to, be converted to AC electricity to drive a motor for a period of time sufficient to empty the storage tank(s) 326 of the fire control agent.

The output of the positive displacement pump 328, such as a piston-type pump, is coupled through two valves 330 and 332 controlled by the controller 322. Two valves 330 and 332 are employed in series for purposes of reliability. The valves 330 and 332 are normally closed so that the hydrocarbon products carried by the pipe line 116, as well as the fluid pressure within the pipe line 116, do not interfere with the underground portion of the fire control system 320. The valves 330 and 332 can be of the ball type, or any other suitable type of electrically operated valve. Where the electrical equipment controlled by the controller 322 requires substantial electrical drive, various drivers can be employed so that the interface 324 does not have to drive such equipment directly.

In operation, when the programmed controller 322 receives an indication from the well head sensor 342 that afire or flame exists at the well head 22, the controller 322 controls the engine 328 (or motor) to start and drive the pump 328. Essentially simultaneously, the valves 330 and 332 are opened so that the fire control agent from the storage tank 326 is pumped through the connecting pipe 334 into the pipe stub 336. In the pipe stub 336, the fire control agent is mixed with the hydrocarbon product forced up the pipe line 116 by the subterranean pressures. As noted above, the engine 338 is operated by the controller 322 with a speed to assure that the pump 328 forces the fire control agent into the pipe stub 336 with a pressure that exceeds the pressure of the hydrocarbon product forced up the stub 336. As long as a fire continues to be sensed at the well site, the controller 322 will control, the apparatus to keep pumping the fire control agent into the hydrocarbon stream at the pipe stub 336. Once all of the fire sensors 342, or a majority of the sensors 342, report that the fire has ceased to exist, then the engine 338 is shut down and the valves 330 and 332 are closed. During the fire extinguishing operation, the flow rate of the production fluid through the pipe line 116 can be measured, and the volume of the fire control agent adjusted based on the hydrocarbon fluid flow rate. During and after the fire incident, the programmed controller 322 causes a transmission to be made to the remote site to report such incident. The measurements and status of the various sensors can be transmitted to the remote site so that a determination can be made as to whether additional fire fighting equipment and personnel is required. When the controller 322 senses that the storage tank 326 is only twenty-five percent full, or other amount, such status can be reported to the remote location so that plans can be made to take additional measures to extinguish the well site fire in the event the fire control agent is all used. A remote site can monitor a number of well sites and maintain general control thereof and keep statistics concerning the incidents and the safety records thereof. If personnel at the remote site determine that the application of the fire control agent should resume, then a command can be transmitted back to the controller 322 to resume the fire control operation.

At times situations can exist where it may be desired to operate the engine 338 but not the pump 328, and have the valves 330 and 332 in the closed state. The engine 338 (or motor) can thus be connected to the pump 328 with a clutch that is controlled by the programmed controller 322. With this arrangement the positive displacement pump 328 will not attempt to pump the fire control agent into the closed valves 330 and 332. Such situations can exist when it is desired to periodically pulse a specified volume of the fire control agent into the pipe stub 336. Here, it would not be advisable to start and stop the engine 338 each time a pulse of the fire control agent is to be injected into the pipe stub 336. Rather, the engine 338 can remain running, and the clutch and valves 332 and 334 can be operated simultaneously to periodically inject a pulse of fire control agent into the pipe stub 336. Alternatively, during the period of time the valves 330 and 332 are closed, the engine 338 can continue driving the pump 328, but recirculate the fire control agent around the pump 328 to prevent the pressure at the output of the pump 328 from exceeding a specified maximum. A release valve set at the acceptable maximum pressure can be used to control the recirculation of the fire control agent around the pump 328 and back to its input.

The pulsing of the fire control agent into the pipe stub 336 can occur when the fire has been extinguished, but there is still a danger of the fire again commencing due to hot metal or objects that could reignite a fire. In this situation, the fire control agent can be periodically injected into the stream of the hydrocarbon product that is escaping the well head 22 or other equipment at the well site, so as to prevent the reignition of a fire. The pulses of the fire control agent can be, for example, twenty-five gallons at a time with one minute between pulses. The timing of the pulses and the amount of the fire control agent pumped during each pulse can be determined experimentally by those skilled in the art. This is especially important in a well head that caps an oil well, as any oil that escapes from the well head falls back to the ground and thus represents a fuel to any flame that may exist. When such a situation exists, a fire could be reignited by hot objects that remain sufficiently hot to cause recombustion of the oil and start another fire. It can be appreciated that it is more expedient to prevent a subsequent fire from occurring, rather than sensing the occurrence of a new fire and having to combat such fire with full force and effect. Moreover, by pulsing the fire control agent, this conserves such material but allows the preventative measure to continue for a longer period of time before the fire control agent must be replenished in the storage tank 326. The pulsing of the fire control agent can be accomplished with the piston pump described below in connection with FIG. 13.

According to the fire control system 320 of FIG. 8, such system includes an emergency shutoff valve 344 for closing off the pipe line 116. The shutoff valve 344 is incorporated into a tubular stub 346 and is bolted into the pipe line 116. The shutoff valve 344 is manually operated so that after a fire has been extinguished, the valve 344 can be shut off to interrupt the flow of the hydrocarbon product produced by the well. The valve 344 can also be automatically operated under control of the programmed controller 322. In this event, a motor and gear arrangement can be utilized to rotate the stem 348 of the valve 344 to move the valve member 350 into an annular slot 352 formed internally to the pipe stub 346, thereby closing the valve 344. Other types of shutoff valves can be utilized.

Bolted to the top portion of the shutoff valve stub 346 is a surge protection stub 354 that incorporates therein a surge protection mechanism 356. The surge protection mechanism 356 senses pressure surges that come from the earth formation in which the well is drilled, and compensates for the same. The surge protection mechanism 356 includes a piston 358 that is moved within the pipe stub 354 in response to an increase in the fluid pressure in the pipe line 116. Also included in the surge protection mechanism 356 is a plunger rod 360 connected to the piston 358. The plunger rod 360 is connected to a diaphragm 362 that moves in a housing 364. A spring 366 works against a stationary plate 368 to urge the diaphragm 362 to the left in the drawing, in a direction to withdraw the piston 358 from the pipe stub 354. The spring 366 is constructed so that with normal pressures in the pipe line 116, the normal pressures do not overcome the force of the spring 366 to move the piston 358 in the direction to choke off the pipe stub 354. The space 370 to the left of the diaphragm, in the housing 364, is connected to the pipe stub 354 via a tube 372. Accordingly, the pressure that exists in the bottom of the pipe stub 354 is coupled to the left side of the diaphragm 362. With this arrangement, if the pressure in the bottom of the pipe, stub 354 exceeds the force of the spring 366, which may be 10,000 psi, then the spring force is overcome and the plunger rod 360 and thus the piston 358 are moved into the pipe stub 354 to choke off the area therein and function as an orifice. The effect of surges that exceed 10,000 psi is subdued or suppressed and the equipment located above the surge protection mechanism 356 is not exposed to excessive pressures. The spring force can be selected or adjusted to achieve the desired threshold by which the piston 358 begins to move. When the pressure surge in the well has subsided, the pressure in the pipe stub 354 is restored to the normal pressure, whereupon the spring 366 moves the piston 358 to the left to reduce the choking effect thereof. This surge protection mechanism 356 can be constructed to manage surges in the well of up to 50,000 psi and above.

The surge protection mechanism 356 not only reduces wear and excessive forces to which the well head 22 experiences, but also the adverse effects on the fire control system 320. Excessive surges can place additional strain on the components of the well head 22, and thus can cause cracks and breakage thereof. The compromised components of the well head 22 can allow the hydrocarbon product to escape therefrom and if a spark exits, an explosion and or fire can result. In addition, excessive pipe line pressures or surges can overcome the pressure of the fire control agent pump 328 and reduce the effectiveness of fire control by the system 320. With the utilization of the surge protection mechanism 356, it is assured that the pressure of the fire control agent injected into the pipe stub 336 exceeds that which exists above the surge protection stub 354. For additional security measures, a check valve can be placed in the connecting pipe 334.

Figure 9:
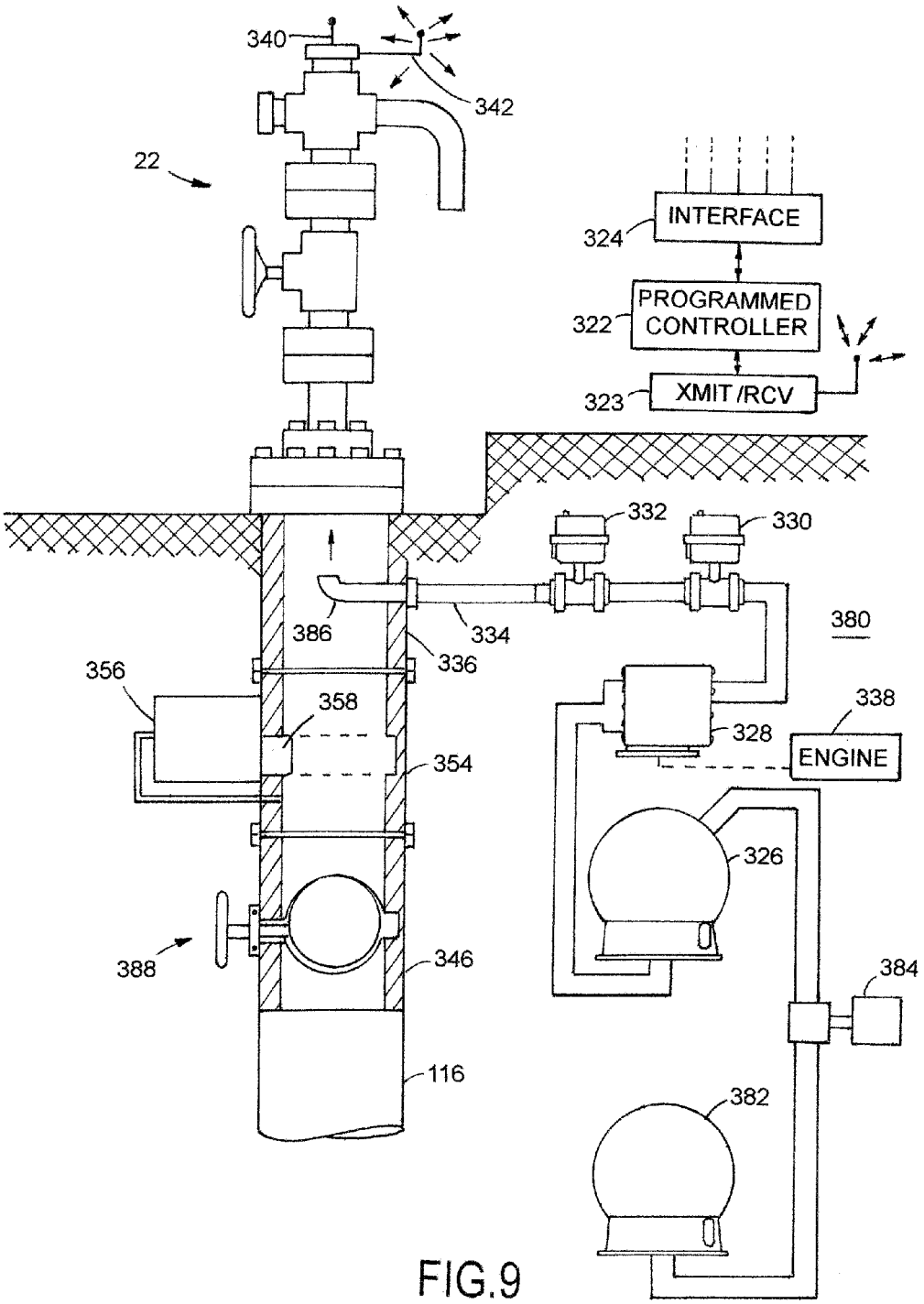
FIG. 9 is another embodiment of a fire control system similar to that of FIG. 8, but employing different equipment to achieve a similar function.

In FIG. 9, a fire control system 380 of another embodiment is, illustrated. Here, a compressed air/gas tank 382 is employed to force a compressed gas into the fire control agent storage tank 326, via valve 384. The source of compressed gas 382 is supplementary, in that it can be brought on line via the valve 384 to force the fire control agent from the supply tank 326 to the input of the positive displacement pump 328. The valve 384 can be of the variable open/close type that can open a specified amount so as to apply some of the gas pressure to the supply tank 326. Again, the valve 384 is controlled by the programmed controller 322. The pressurized fire control agent is injected into the pipe stub 336 byway of an upturned J-shaped tube 386. The end of the J-shaped tube is directed upwardly to inject the fire control agent in the middle of the stream of the hydrocarbon product being produced by the well. Mixing of the fire control agent with the hydrocarbon product inside the pipe stub 336 is thereby enhanced. This embodiment of the fire control system 380 employs a ball-type valve 388 as an emergency shutoff mechanism for completely closing off the flow of the hydrocarbon product from the underlying well. The ball valve 388 can be manually operated, or motor operated under control of the programmed controller 322.

Figure 10:
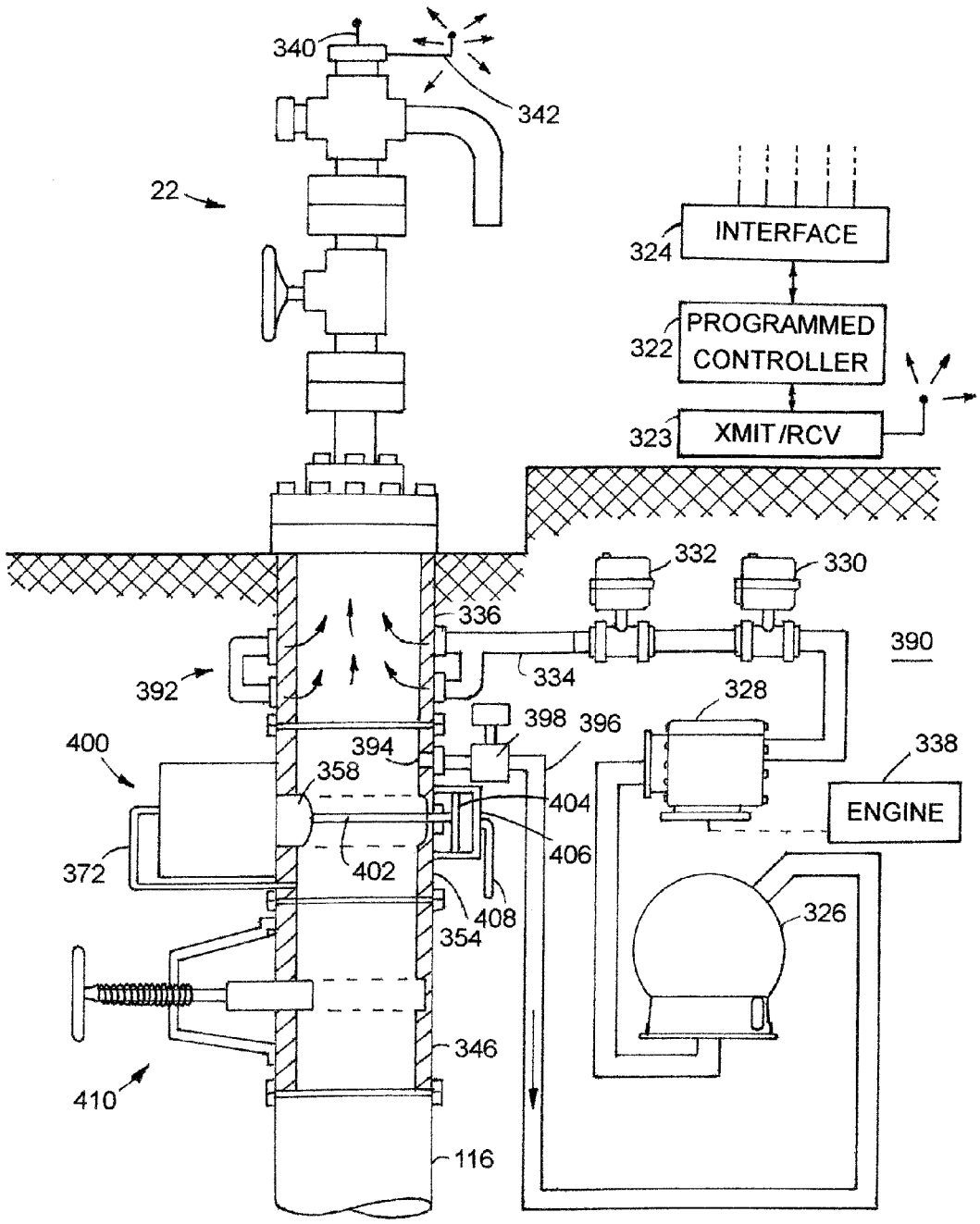
FIG. 10 is another embodiment of a fire control system similar to that of FIG. 8, but employing different equipment to achieve a similar function.

The fire control system 390 of FIG. 10 illustrates yet other apparatus that can be employed in extinguishing a fire at the well site. The injection equipment 390 includes a dual manifold 392 that injects the fire control agent at multiple ports around the pipe stub 336, and at different vertical levels on the pipe stub 336. This presents an efficient technique of injecting the fire control agent for thorough mixing with the hydrocarbon product that is produced by the well. A port 394 is formed in the pipe stub 354 and together with suitable piping 396, the gas pressure in the pipe line 116 is coupled, to the supply tank 326. A controller-controlled variable valve 398 is fixed in piping 396 to control the gas pressure applied to the supply tank 326. With this arrangement, the positive displacement pump 328 is assisted using the well head pressure. The valve 398 assures that the gas flow in the piping 396 is proportional to that of the well head gas pressure. The pipe stub 354 is equipped with a surge protector 400 of the diaphragm type illustrated in FIG. 8, but without the spring 366. Rather, the piston 358 is connected by a rod 402 to another diaphragm 404 that moves in housing 406. By applying an external pressure via the tubing 408, the lateral position of the piston 358 can be controlled. In essence, the diaphragm 404 and the source of external pressure applied to the tubing 408 functions as a spring force. As with the surge protection mechanism 356 described in FIG. 9, the pressure in the pipe stub 354 is sensed and applied to the left-hand diaphragm 362 (not shown) via the tubing 372 to sense pressure surges. The piston 358 can be equipped with one or more vertical holes therein so that when in the fully closed position, some of the pressure in the well can escape upwardly and prevent an excessive buildup of downhole pressures. The other surge protectors described herein can be equipped with similar air pressure release holes. Other air pressure release apparatus can also be employed, including pressure relief valves, burst discs, etc. A gate-type valve 410 is employed as an emergency shutoff valve in the fire control system 390, where the gate valve 410 can be either manually operated or operated under control of the programmed controller 322.

Figure 11:
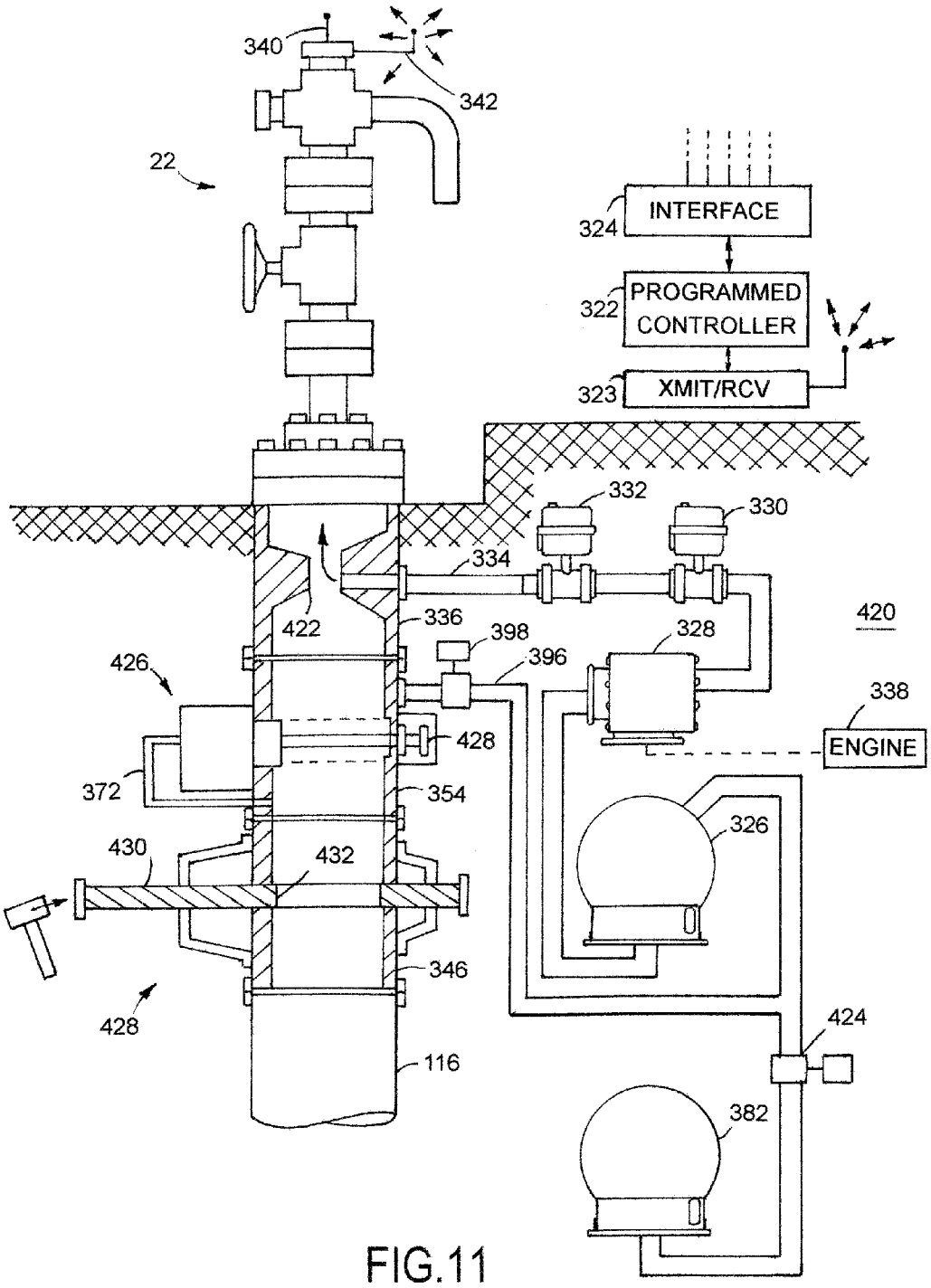
FIG. 11 is another embodiment of a fire control system similar to that of FIG. 8, but employing different equipment to achieve a similar function.

FIG. 11 illustrates another fire control system 420 constructed according to the invention. The fire control agent is injected into the pipe stub 336 using a venturi 422. The venturi 422 is constructed to constrict the fluid passage inside the pipe stub 336 and thus create a low pressure area, while the velocity of the hydrocarbon product passing through the venturi 422 is increased, i.e., the Bernoulli principle. The venturi action is similar to the function of a jet pump or educator. The low pressure area in the narrowed part of the venturi 422 effectively pulls the fire control agent out of the connecting pipe 334. This effectively increases the pressure differential across the pump 328 to thereby increase the efficiency in delivering the fire control agent into the pipe stub 336, and thus to the hydrocarbon product. The venturi 422 can be employed with the manifold 392 of FIG. 10 to thereby allow the fire control agent to be drawn into the constricted area through numerous openings. The removal of the fire control agent from the supply tank 326 is assisted by two means. First, the gas pressure in the pipe stub 354 can be coupled via the valve 398 and the piping 396 to the input of the supply tank 326. The valve 398 would be opened to the desired amount to help pressurize the supply tank 326, while valve 424 is closed. Secondly, the pressurized gas of the pressurized tank 382 can be coupled via the valve 424 to the input of the supply tank 326 to assist in removing the fire control agent therefrom. It should be appreciated that venturi equipment can be utilized for mixing of two or more fire control agents and associated chemicals from respective storage tanks and coupling the mixture to the nozzles for injection into the hydrocarbon fluid stream. A surge protection mechanism 426 can be of the diaphragm type described above in connection with FIG. 8, but instead of a spring 366, a hydraulic or pneumatic pressure is employed to act on the piston 428. The emergency shutoff valve 428 is of the manual type where an apertured plate 430 is struck with a hammer, or the like, to move the plate 430 to the right in the drawing to thereby close the pipe stub 346 and shut off fluid flow therethrough. The apertured plate 430 of the valve 428 is shown open, with the aperture 432 being aligned with the passage of the pipe stub 346. To open the shutoff valve 428, the aperture plate 430 is struck from the other side to again align the aperture 432 with the passage of the pipe stub 346. The manually-operated emergency shutoff valve 428 is less susceptible to aging and corrosion than the more sophisticated counterpart valves.

Figure 12:
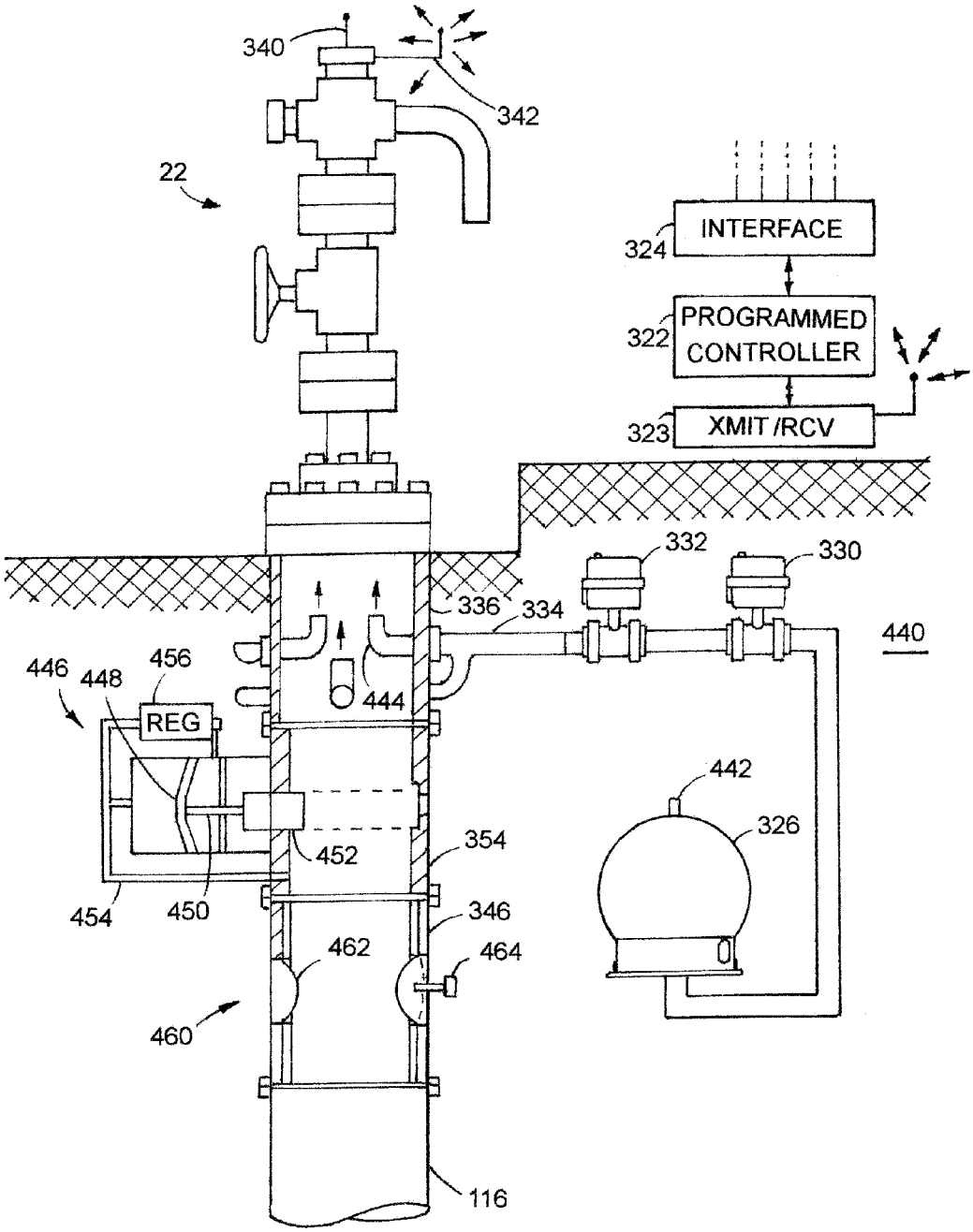
FIG. 12 is another embodiment of a fire control system similar to that of FIG. 8, but employing different equipment to achieve a similar function.

Another embodiment of a fire control system 440 is illustrated in FIG. 12. In this embodiment, the supply tank 326 is pressurized so that the fire control agent is forced out of such tank 326 when the exit outlet is opened. The valves 332 and 330 control whether the fire control agent will be forced out of the supply tank 326 and into the pipe stub 336. The supply tank 326 can be pressurized by way of a coupling 442 attached to a side wall of the supply tank 326. Various types of air compressors can be utilized to pressurize the supply tank 326. The air pressure inside the supply tank 326 can be monitored by the controller 322 using a suitable pressure sensor. The fire control agent is injected from the connecting pipe 334 into multiple 3-shaped tubes, one shown as numeral 444. The surge protection mechanism includes a diaphragm 448 connected to a rod 450 that drives a piston 452. The diaphragm 448 reacts to differential pressures on each side thereof. On one side of the diaphragm 448, the pressure inside the pipe stub 354 is coupled thereto by way of the tubing 454. The tubing 454 also couples the pipe stub pressure to a regulator 456, and from the regulator 456 to the other side of the diaphragm 448. The regulator 456 maintains essential a constant pressure on the other side of the diaphragm 448. Thus, as the surge pressure in the pipe stub 354 increases, the diaphragm 448 moves to the right to thereby choke the pipe stub 354 and reduce the pressure on the downstream side of the surge protection mechanism 446. As the pressure in the pipe stub 354 is reduced, the piston 452 moves in a direction to open the restriction presented by the piston 452. The emergency shutoff valve 460 comprises a pressure-operated pinch-off mechanism to close the pipe stub 346 during emergencies. The shutoff valve 460 is constructed with a flexible membrane 462 which, when inflated, expands into the pipe stub 346 to close the passage therethrough. There is a circumferential pocket around the flexible membrane 462 into which air or a gas can be injected to inflate the annular membrane 462. A nipple 464 is connected to the pocket so that air pressure equipment can be connected thereto for injecting air or gas into the pocket to inflate the membrane 462. The pressure in the well can be input into a pressure pump to achieve a higher pressure to inflate the flexible membrane 462.

Figure 13:
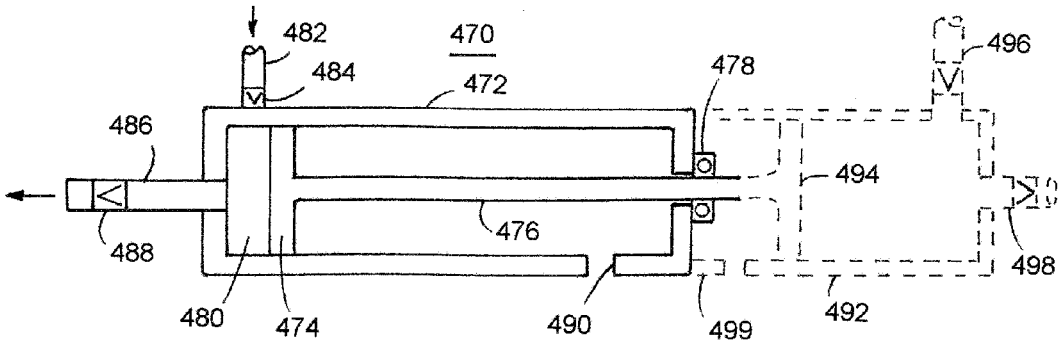
FIG. 13 illustrates a fire control pump of the reciprocating type that pulses the fire control agent into the well head pipeline.

FIG. 13 is a diagram of a mechanism 470 that is effective to pump a fire control agent into the pipe stubs 336 of the embodiments illustrated in FIGS. 8-12. The mechanism 470 is constructed with a cylindrical housing 472 in which a piston 474 operates. The piston 474 is driven in reciprocating directions by a shaft 476. The shaft 476 is sealed to the housing 472 with a seal 478. The fire control agent is drawn, into the chamber 480 when the piston 474 is moved to the right in the drawing by the shaft 476. The entry of the fire control agent into the chamber 480 is through the inlet pipe 482 and a check valve 484. The outlet check valve 488 closes and prevents fluid from being pulled into the chamber from the pipe stub 336. Any air or gas that is behind the piston 474 is exhaust out of the housing 472 via the vent 490. When the chamber 480 has, expanded to its fullest extent and is full of the fire control agent, then the direction of travel of the shaft 476 and thus the piston 474 is reversed, whereupon the fire control agent is forced out of the chamber 480 via the outlet pipe 486 and the check valve 488. The closed check valve 482 prevents the fire control agent from being forced back into the storage tank 326. The fire control agent is forced into the pipe stub 336 and into the fluid stream of the well. Atmospheric air can enter the housing 472 behind the piston 474 during this cycle by the vent 490. The fire control agent can be forced into other apparatus at other locations for mixing with the fluid stream produced by the well. The pump apparatus 470 is effective to pulse the fire control agent into the fluid stream of the well. The shaft 476 can be driven in a reciprocating manner by various means, including a crank arm, pneumatic or hydraulic means, and many other techniques, including the pressure of the well casing itself through the vent 490.

As an alternative mode of operation, the pressurized fire control agent input at inlet 482 can be used to return the piston 474 to the right. Valves can be utilized to control the pressurized fluids applied to the inlet and outlet vents to achieve a reciprocating motion. A fire control agent pressure of only 100 psi applied to a piston 474 having an area of only four square inches produces a force of 400 pounds to move the piston 474 to the right. The external valving arrangement can be operated by the controller 322 to bleed off the air pressure behind the piston 474 via vent 490 when moving to the right. With this arrangement, the well, pressure can be used to force the piston 474 to the left, and the pressurized fire control agent can be used to force the piston 474 to the right.

While the pressurized fire control agent and the downhole well pressure is controlled to reciprocate the piston 474 of the master pump 472, the same forces can be used to operate a slave pump 492 that is slaved by the piston shaft 476 to the master pump 472. The slave pump 492 is illustrated in broken line. Here, the piston shaft 476 of the master pump 472 is connected through seal 478 to a piston 494 of the slave pump 492. In a first reciprocating cycle, when the pressurized fire control agent forces the piston 474 of the master pump 472 to the right to draw in the fire control agent into chamber 480, the fire control agent in the slave pump 492 is at the same time forced out of the outlet 498 and into the hydrocarbon fluid stream. In the second pump cycle, when the piston 474 of the master pump 472 is moving to the left to force the fire control agent in chamber 480 into the hydrocarbon fluid stream, the piston 494 of the slave pump 492 is drawing in the fire control agent via the inlet 496. The two reciprocating cycles repeat to provide a pulse of the fire control agent during each such cycle.

Figure 14:
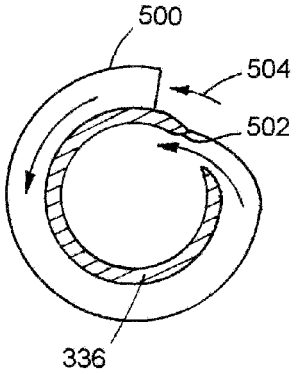
FIG. 14 illustrates a volute for adding a fire control agent into the well head pipeline in a swirling action to facilitate mixing with the fluid produced by the well.

The volute 500 of FIG. 14 can be employed to couple the pressurized fire control agent into the pipe stub 336 in a swirling manner. The volute 500 is tubular in shape and either encircles or spirals around the cylindrical pipe stub 336. The exit end of the tubular volute 500 is coupled to an opening 502 of the pipe stub 336. The pressurized fire control agent enters the volute 500 at the entry opening as shown by arrow 504. The fire control agent circles around and then enters into the pipe stub 336 and swirls therein to facilitate the mixing of the fire control agent with the fluid produced by the well. The mixing of the fluids is facilitated by the swirling action caused by the volute 500.

Another protective measure that can be taken at a well site is the use of shear bolts and other similar apparatus for connecting various parts, components or joints of the fluid carrying equipment together. The well head components can also be joined together using shear apparatus such as collars, joints, unions, couplings or other types of apparatus that is characterized by separating when shear forces exceed a specified amount. Sometimes a well head is damaged by impact, such as other structures falling onto the well head, a collision with a moving vehicle or object, and other events. Depending on the type of damage to the well head, such as the bending or distortion of parts, the ability of the fire control system may be adversely affected. This can be reduced by utilizing shear bolts to connect the vulnerable well head components together so that if struck by a heavy object, the components will separate without bending or causing damage of the type that would compromise the effectiveness of the fire control system.

The various, fire control systems described above can also be incorporated at sea or ocean locations, such as with bottom founded drilling rigs, jackup rigs, swamp barges, combined drilling and production facilities either bottom founded or floating platforms, and deep water mobile offshore drilling'units (MODU), including semi-submersibles and drill ships. In such situations, the one or more fire control agent storage tanks can be located either on top of the offshore drilling/production rig, or attached to it, or alternatively embedded underground below the seabed or sea floor. Further, submerged piping or tubing can be connected from the storage tanks to the well bore either above the seabed or embedded below the seabed, and joined to the wellbore or main drilling or production pipeline.

While the invention and its several embodiments have been described in connection with oil and gas wells and corresponding well heads, the principles and concepts of the invention can be employed in many other applications. For example, where a fuel is transferred from one tank or reservoir to another, the fire control system can be employed to protect such a site from an uncontrolled fire. In industries where volatile liquids are stored in tanks and used in various processes, the fire control system can be used to provide protection should a leak occur in the pipes carrying such liquids. An application can be the protection for natural gas or other volatile gas flaring tubes. The fire control system can be implemented in many situations to minimize the damage of, a fire and prevent it from turning into, an uncontrolled conflagration. Also, while the fire control system has been described in connection with the use of a positive displacement pump, other pump types can be used as well, such as a diaphragm pump, a centrifugal pump, a vane pump, a screw pump, progressive pump, etc.

Having thus described the several embodiments of the present invention, those of skill in the art will readily appreciate that other embodiments may be made and used which fall within the scope of the claims attached hereto. Numerous advantages of the invention covered by this document have been set forth in the foregoing description. It will be understood that this disclosure is, in many respects, only illustrative. Changes can be made with respect to various elements described herein without exceeding the scope of the invention. Although the present invention has been described in considerable detail with reference to certain preferred versions or embodiments thereof, other versions and embodiments are possible. Therefore, the spirit and scope of the appended claims should not be limited to the description of the preferred versions described herein.

What is claimed is:

1. A fire control system for use with a hydrocarbon extraction system of the type that extends underground and carries a hydrocarbon fluid stream to the surface, said fire control system comprising:

at least one storage tank located at a site of the hydrocarbon extraction, at least one said storage tank is for storing a fire control agent;

an injector for injecting the fire control agent into the hydrocarbon fluid stream so that the fire control agent is carried with the hydrocarbon fluid stream; and said hydrocarbon extraction system includes a pipeline that extends from an underground location, and said injector injects the fire control agent into the underground pipeline.

2. The fire control system of claim 1, wherein said pipeline extends from the underground location to an above ground well head, and said injector injects the fire control agent into the above ground well head.

3. The fire control system of claim 1, wherein said at least one storage tank is located above ground.

4. The tire control system of claim 1, further including a tank holding a pressurized gas, and wherein said pressurized gas is used to force the fire control agent out of said at least one storage tank.

5. The fire control system of claim 1, further including a valve through which the fire control agent is coupled to said injector, said valve operative to be opened for allowing the fire control agent to be coupled to said injector to extinguish a fire that burns the hydrocarbon fluid.

6. The fire control system of claim 1, further including a pipe stub connected in line to a pipeline carrying the hydrocarbon fluid, said pipe stub equipped with a shutoff valve for controlling a flow of the hydrocarbon fluid through the pipeline.

7. A fire control system for use with a hydrocarbon extraction system of the type that extends underground and carries a hydrocarbon fluid stream to the surface, said fire control system comprising:

a storage tank located at a site of the hydrocarbon extraction, said storage tank for storing a fire control agent;

means for pressurizing the fire control agent;

an injector for injecting the pressurized fire control agent into the hydrocarbon fluid stream so that the fire control agent is carried with the hydrocarbon fluid stream; and a pump for pulsing the pressurized fire control agent into said injector.

8. The fire control system of claim 7, further including a valve for controlling the pressurized fire control agent coupled to said injector, and wherein said valve is closed between pulses of the fire control agent.

9. A method of controlling conditions relating to a fire at a site of an oil or gas extraction operation carrying a hydrocarbon fluid stream, said method comprising:

storing a fire control agent in a storage tank at the site;

pressurizing the fire control agent and injecting the fire control agent into the hydrocarbon fluid stream; and carrying the hydrocarbon fluid stream and said fire control agent to a location of a fire for facilitating the control of the fire.

10. The method of claim 9, further including storing said storage tank underground and injecting the fire control agent into the hydrocarbon fluid stream at an underground location.

11. A fire control system for use with a hydrocarbon extraction system of the type that extends underground and carries a hydrocarbon fluid stream to the surface, said fire control system comprising:

at least one storage tank located at a site of the hydrocarbon extraction, at least one said storage tank is for storing a fire control agent;

wherein said at least one storage tank is located underground; and an injector for injecting the fire control agent into the hydrocarbon fluid stream so that the fire control agent is carried with the hydrocarbon fluid stream.

12. A fire control system for use with a hydrocarbon extraction system of the type that extends underground and carries a hydrocarbon fluid stream to the surface, said fire control system comprising:

at least one storage tank located at a site of the hydrocarbon extraction, at least one said storage tank is for storing a fire control agent;

an injector for injecting the fire control agent into the hydrocarbon fluid stream so that the fire control agent is carried with the hydrocarbon fluid stream; and a pump for pumping the fire control agent from said at least one storage tank to said injector, and wherein said pump is located underground.

13. The fire control system of claim 12, further including a torque producer for driving said pump, and said torque producer is located underground.

14. A fire control system for use with a hydrocarbon extraction system of the type that extends underground and carries a hydrocarbon fluid stream to the surface, said fire control system comprising:

at least one storage tank located at a site of the hydrocarbon extraction, at least one said storage tank is for storing a fire control agent;

an injector for injecting the fire control agent into the hydrocarbon fluid stream so that the fire control agent is carried with the hydrocarbon fluid stream; and wherein said at least one storage tank is pressurized for forcing a pressurized fire control agent out of the pressurized storage tank to said injector.

15. A fire control system for use with a hydrocarbon extraction system of the type that extends underground and carries a hydrocarbon fluid stream to the surface, said fire control system comprising:

at least one storage tank located at a site of the hydrocarbon extraction, at least one said storage tank is for storing a fire control agent;

an injector for injecting the fire control agent into the hydrocarbon fluid stream so that the fire control agent is carried with the hydrocarbon fluid stream; and further including a pipe stub connected in line to a pipeline carrying the hydrocarbon fluid stream, said pipe stub equipped with a surge protector for reducing surge pressures above said surge protector.

16. A fire control system for use with a hydrocarbon extraction system of the type that extends underground and carries a hydrocarbon fluid stream to the surface, said fire control system comprising:

at least one storage tank located at a site of the hydrocarbon extraction, at least one said storage tank is for storing a fire control agent;

an injector for injecting the fire control agent into the hydrocarbon fluid stream so that the fire control agent is carried with the hydrocarbon fluid stream; and further including a pipe for coupling a fluid pressure from a pipeline carrying the hydrocarbon fluid to said at least one storage tank to force the fire control agent from said at least one storage tank.

17. A fire control system for use with a hydrocarbon extraction system of the type that extends underground and carries a hydrocarbon fluid stream to the surface, said fire control system comprising:

at least one storage tank located at a site of the hydrocarbon extraction, at least one said storage tank is for storing a fire control agent;

an injector for injecting the fire control agent into the hydrocarbon fluid stream so that the fire control agent is carried with the hydrocarbon fluid stream; and further including a programmed controller and a fire sensor located at a site of the hydrocarbon extraction system, said controller programmed to monitor said fire sensor and when a fire is detected at the site, said controller controls the fire control system to cause the fire control agent to be injected into the hydrocarbon fluid stream.

* * * * *